US010561916B1

(12) United States Patent
Campbell et al.

(10) Patent No.: US 10,561,916 B1
(45) **Date of Patent: *Feb. 18, 2020**

(54) SPORTS TRAINING MACHINE

(71) Applicant: Airborne Athletics, Inc., Bloomington, MN (US)

(72) Inventors: Douglas B. Campbell, Loretto, MN (US); Jeffrey J. Campbell, Lonsdale, MN (US)

(73) Assignee: Airborne Athletics, Inc., Bloomington, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/377,454

(22) Filed: Apr. 8, 2019

Related U.S. Application Data

(63) Continuation of application No. 15/958,733, filed on Apr. 20, 2018, now Pat. No. 10,252,133, which is a (Continued)

(51) Int. Cl.

| | |
|---|---|
| ***A63B 69/00*** | (2006.01) |
| ***A63B 69/40*** | (2006.01) |
| ***A63B 47/00*** | (2006.01) |
| ***A63B 24/00*** | (2006.01) |
| ***A63B 71/02*** | (2006.01) |

(Continued)

(52) U.S. Cl.

CPC ..... *A63B 69/0071* (2013.01); *A63B 24/0062* (2013.01); *A63B 24/0087* (2013.01); *A63B 47/002* (2013.01); *A63B 47/02* (2013.01); *A63B 69/40* (2013.01); *A63B 69/409* (2013.01); *A63B 71/022* (2013.01); *A63B 71/0622* (2013.01); *A63B 2024/0068* (2013.01); *A63B 2024/0093* (2013.01); *A63B 2071/025* (2013.01); *A63B 2220/801* (2013.01); *A63B 2220/802* (2013.01); *A63B 2220/805* (2013.01); *A63B 2225/093* (2013.01); *A63B 2225/50* (2013.01); *A63B 2230/062* (2013.01); *A63B 2230/30* (2013.01); *A63B 2230/42* (2013.01); *A63B 2230/436* (2013.01); *A63B 2230/75* (2013.01)

(58) Field of Classification Search

None

See application file for complete search history.

(56) References Cited

U.S. PATENT DOCUMENTS

| | | | |
|---|---|---|---|
| 1,223,386 | A | 4/1917 | Handelan |
| 2,908,266 | A | 10/1959 | Cooper |

(Continued)

OTHER PUBLICATIONS

Airborne Athletics, Inc, Dr. Dish Owner's Manual, Aug. 2011, 1-28.

(Continued)

*Primary Examiner* — Tramar Y Harper

(74) *Attorney, Agent, or Firm* — Fish & Richardson P.C.

(57) ABSTRACT

A basketball training apparatus includes a shot completion sensor, a condition sensor, and a computer. The shot completion sensor determines whether a shot goes through a basketball hoop. The condition sensor senses a physical condition of a basketball shooter. The computer is in communication with the shot completion sensor and the condition sensor, and has a processor for calculating shot completion percentage as a function of the physical condition.

20 Claims, 5 Drawing Sheets

Related U.S. Application Data continuation of application No. 15/599,057, filed on May 18, 2017, now Pat. No. 9,975,026, which is a continuation of application No. 14/080,560, filed on Nov. 14, 2013, now Pat. No. 9,724,584.

(60) Provisional application No. 61/726,741, filed on Nov. 15, 2012.

(51) Int. Cl.
*A63B 71/06* (2006.01)
*A63B 47/02* (2006.01)

(56) References Cited

U.S. PATENT DOCUMENTS 3,776,550 A * 12/1973 McNabb ..... A63B 63/083 473/436
3,802,703 A 4/1974 Van Tassel
3,878,828 A 4/1975 Francesco
4,168,695 A 9/1979 Haller et al.
4,262,648 A 4/1981 Wegener et al.
4,471,746 A 9/1984 Ando
4,517,953 A 5/1985 Osaka et al.
4,579,340 A 4/1986 Jenkins et al.
4,667,957 A 5/1987 Joseph
4,678,189 A 7/1987 Koss
4,714,248 A 12/1987 Koss
4,913,431 A 4/1990 Jakobs
4,915,384 A * 4/1990 Bear ..... A63B 24/0021 273/454
4,936,577 A 6/1990 Kington et al.
4,940,231 A 7/1990 Ehler
4,955,605 A 9/1990 Goldfarb
5,016,875 A 5/1991 Joseph
5,125,651 A 6/1992 Keeling et al.
5,183,253 A 2/1993 Grimaldi et al.
5,312,099 A 5/1994 Oliver, Sr.
5,393,049 A 2/1995 Nelson
5,409,211 A 4/1995 Adamek
5,417,196 A 5/1995 Morrison et al.
5,540,428 A 7/1996 Joseph
5,601,284 A 2/1997 Blackwell et al.
5,692,978 A 2/1997 Hummel
5,676,120 A 10/1997 Joseph
5,681,230 A * 10/1997 Krings ..... A63B 63/083 124/26
5,746,668 A 5/1998 Ochs
5,771,018 A 6/1998 Kennedy
5,776,018 A 7/1998 Simpson
5,813,926 A 9/1998 Vance
5,842,699 A 12/1998 Mirando et al.
5,937,143 A 8/1999 Watanabe
5,980,399 A 11/1999 Campbell et al.
6,167,328 A 12/2000 Takaoka
6,224,503 B1 5/2001 Joseph
6,241,628 B1 * 6/2001 Jenkins ..... A63B 69/0071 124/6
6,280,352 B1 8/2001 Coffeen
6,302,811 B1 10/2001 Topham
6,389,368 B1 * 5/2002 Hampton ..... A63B 24/0084 702/179
6,458,049 B2 10/2002 Bush
6,659,893 B1 12/2003 Campbell et al.
6,707,487 B1 3/2004 Aman
7,056,237 B2 6/2006 Slavey et al.
7,066,845 B2 6/2006 Joseph
7,288,034 B2 10/2007 Woodard et al.
7,641,574 B2 1/2010 Steen
7,927,237 B2 4/2011 Jenkins
7,945,349 B2 5/2011 Svensson
7,970,492 B2 6/2011 Matsushima
8,012,046 B2 9/2011 Campbell et al.
8,123,634 B1 2/2012 Lovett
8,147,356 B2 4/2012 Campbell et al.
8,206,246 B2 6/2012 Joseph
8,617,008 B2 12/2013 Marty
8,727,784 B1 5/2014 Wolf
8,845,460 B1 9/2014 Feldstein
8,852,030 B2 10/2014 Campbell et al.
9,017,188 B2 4/2015 Joseph
D739,488 S 9/2015 Campbell et al.
9,199,150 B2 12/2015 Wackerly
9,444,306 B2 9/2016 Bradfield
9,452,339 B1 9/2016 Shah
9,569,005 B2 2/2017 Ahmed
9,724,584 B1 8/2017 Campbell et al.
9,808,696 B2 11/2017 Campbell et al.
9,975,026 B2 5/2018 Campbell et al.
10,004,949 B2 6/2018 Brothers et al.
2001/0052472 A1 12/2001 Ikeda
2002/0016236 A1 2/2002 Stearns
2002/0072681 A1 6/2002 Schnali
2002/0147404 A1 10/2002 Kato
2003/0073518 A1 * 4/2003 Marty ..... A63B 24/0021 473/416
2004/0092840 A1 5/2004 Nakada
2005/0085320 A1 4/2005 Joseph et al.
2005/0187036 A1 8/2005 Ziola et al.
2005/0215870 A1 9/2005 Rademaker
2006/0057549 A1 * 3/2006 Prinzel, III ..... A61B 5/0002 434/247
2006/0138809 A1 * 6/2006 Joseph ..... A47C 13/00 297/129
2006/0160639 A1 7/2006 Klein
2007/0026974 A1 2/2007 Marty et al.
2007/0208544 A1 * 9/2007 Kulach ..... A61B 5/1112 702/189
2008/0015061 A1 1/2008 Klein
2008/0171620 A1 7/2008 Feldmeier
2008/0254866 A1 10/2008 Young et al.
2008/0261726 A1 10/2008 Chipperfield
2009/0047645 A1 2/2009 Dibenedetto et al.
2009/0137347 A1 * 5/2009 Jenkins ..... A63B 69/0071 473/433
2009/0191988 A1 * 7/2009 Klein ..... A63B 24/0021 473/480
2009/0270743 A1 10/2009 Dugan et al.
2009/0325739 A1 12/2009 Gold
2010/0259412 A1 10/2010 Pagonakis
2010/0261557 A1 10/2010 Joseph et al.
2010/0292033 A1 * 11/2010 Sarver ..... A63B 63/00 473/431
2011/0084925 A1 4/2011 Baik
2012/0015778 A1 * 1/2012 Lee ..... A63B 71/0622 482/8
2012/0142454 A1 6/2012 Campbell et al.
2012/0322587 A1 * 12/2012 Duke ..... A63B 69/0071 473/450
2013/0005512 A1 * 1/2013 Joseph ..... A63B 24/0075 473/431
2013/0157786 A1 6/2013 Joseph et al.
2013/0272393 A1 10/2013 Kirenko
2014/0031703 A1 1/2014 Rayner
2014/0081436 A1 3/2014 Crowley
2014/0222177 A1 8/2014 Thurman
2014/0371885 A1 12/2014 Ianni
2015/0131845 A1 5/2015 Forouhar
2015/0306455 A1 10/2015 Decarlo
2016/0001136 A1 1/2016 King
2016/0250540 A1 9/2016 Joseph
2016/0325166 A1 11/2016 Wallace
2016/0332054 A1 11/2016 Smith
2017/0232298 A1 8/2017 Joseph et al.

OTHER PUBLICATIONS

Airbone Athletics, Inc. 1 page advertising brochure, © Airbone Athletics, Inc., before 2012.
Brochure entitled "Sniper: The Ultimate Basketball Trainer", before Oct. 22, 1995, 5 pages incluciing U1e cover letter.

(56) References Cited

OTHER PUBLICATIONS

Brochure entitled "The All New 8000 Series Gun" by Shoot-A-Way, before Oct. 12, 2011, 12 pages.
Brochure entitled "The Shoot Away: The perfect Shooting Aid", before Dec. 2, 2011.

* cited by examiner

SPORTS TRAINING MACHINE

CROSS-REFERENCE TO RELATED APPLICATION(S)

This application is a continuation of U.S. patent application Ser. No. 15/958,733 filed on Apr. 20, 2018, which is a continuation of U.S. patent application Ser. No. 15/599,057, filed on May 18, 2017, and entitled "SPORTS TRAINING MACHINE," which is a continuation of U.S. patent application Ser. No. 14/080,560, filed on Nov. 14, 2013, and entitled "SPORTS TRAINING MACHINE," which claims priority to U.S. Provisional Application No. 61/726,741, filed on Nov. 15, 2012, and entitled "SPORTS TRAINING MACHINE," the disclosure of which is incorporated by reference. Reference is also made to application Ser. No. 13/310,173 entitled "BASKETBALL RETURN APPARATUS WITH ROTATABLE BALL COLLECTOR" which was filed on Dec. 2, 2011 and is assigned to the same assignee as this application, the disclosure of which is incorporated by reference in its entirety.

BACKGROUND

The present invention relates to sports training, and in particular, to machines for use in basketball, volleyball, and other sports training.

"Practice makes perfect," so the adage goes. The game of basketball (as well as other sports) is not exempt from this age old adage. Practice is known to improve a player's basketball skills. Taking numerous shots at a basketball hoop is a key element of basketball practice as it develops the player's shooting ability and technique. However, unless a second player is present to rebound for the first player (the shooter), the first player must rebound his or her own shots. This rebounding process wastes time that could otherwise be used by the player to practice skills including shooting.

A wide variety of ball collectors have been conceived to collect basketballs shot at a basketball goal (including a backboard with an attached hoop). These ball collectors generally include netting and a frame positioned under and around the basketball goal. Ball collectors are often used in conjunction with a ball returner, which directs a ball back from the ball collector to the shooter.

Motorized ball returners can return basketballs to a shooter at various locations on a basketball court. Ball returners can be motorized and have programs that determine which direction to return balls, how many times to return the ball, etc. However, such ball returners can return basketballs only in a manner in which the ball returner is already programmed. This limits the usefulness of such ball returners.

Some motorized ball returners also calculate shooting percentage. A shot completion sensor senses whether a basketball goes through a basketball hoop, and sends that data to a computer that then calculates a shooting percentage over several shots. Such systems provide information on whether a shooter is shooting well or poorly, but do not provide data on why the shooter is shooting well or poorly.

SUMMARY

According to the present invention, a basketball training apparatus includes a shot completion sensor, a condition sensor, and a computer. The shot completion sensor determines whether a shot goes through a basketball hoop. The condition sensor senses a physical condition of a basketball shooter. The computer is in communication with the shot completion sensor and the condition sensor, and has a processor for calculating shot completion percentage as a function of the physical condition.

Another embodiment of the present invention is a training apparatus. A ball returner is connected to a ball collector for receiving balls from the ball collector and returning the balls to a user. A condition sensor senses a physical condition of the user. A computer is connected to the ball returner and in communication with the condition sensor. The computer has an output interface for outputting physical condition data of the user.

Another embodiment of the present invention is a method. The method includes sensing a physical condition of a basketball shooter and sensing whether a shot from the basketball shooter goes through a basketball hoop. The method further includes calculating a shot completion percentage for the shooter as a function of the physical condition of the shooter and outputting the shot completion percentage for the shooter as a function of the physical condition of the shooter via an output interface.

Another embodiment of the present invention is a training apparatus including a ball collector, a motorized ball returner, and a computer. The motorized ball returner is connected to the ball collector for receiving balls from the ball collector and returning those balls to the user. The computer is connected to the motorized ball returner and in communication with a website for receiving internet-based drill program instructions. The computer includes a machine controller for controlling angle and velocity with which the motorized ball returner throws balls to the user according to the internet-based drill program instruction.

Another embodiment of the present invention is a method for programming a motorized ball return apparatus. The method includes storing a plurality of sets of drill program instructions executable by a motorized ball return apparatus in at least one computer storage medium, wherein each set of drill program instructions corresponds to one of a plurality of internet-based drill programs for use with the motorized ball return apparatus. The method further includes displaying on a website the plurality of internet-based drill programs, receiving a request from a computer to transmit a first set of drill program instructions, and transmitting the first set of drill program instructions over an internet connection to the computer.

Another embodiment of the present invention is a basketball training apparatus including a ball collector, a motorized ball returner, a condition sensor, and a computer. The ball collector has a top opening and a bottom opening. The motorized ball returner is connected to the ball collector for receiving balls from the ball collector and returning the balls to a basketball shooter. The condition sensor senses heart rate of the basketball shooter. The computer is in communication with the motorized ball returner and the condition sensor. The computer adjusts speed of the ball returner depending on whether the user heart rate is greater than or less than a target heart rate.

Another embodiment of the present invention is a training apparatus including a ball collector, a ball returner, a condition sensor, and a computer. The ball returner is connected to the ball collector for receiving balls from the ball collector and returning the balls to a player. The condition sensor senses a physical condition of the player. The computer is in communication with the ball returner and the condition sensor. The computer adjusts speed of the ball returner depending on whether the physical condition is greater than or less than a target physical condition.

DETAILED DESCRIPTION

Figure 1:
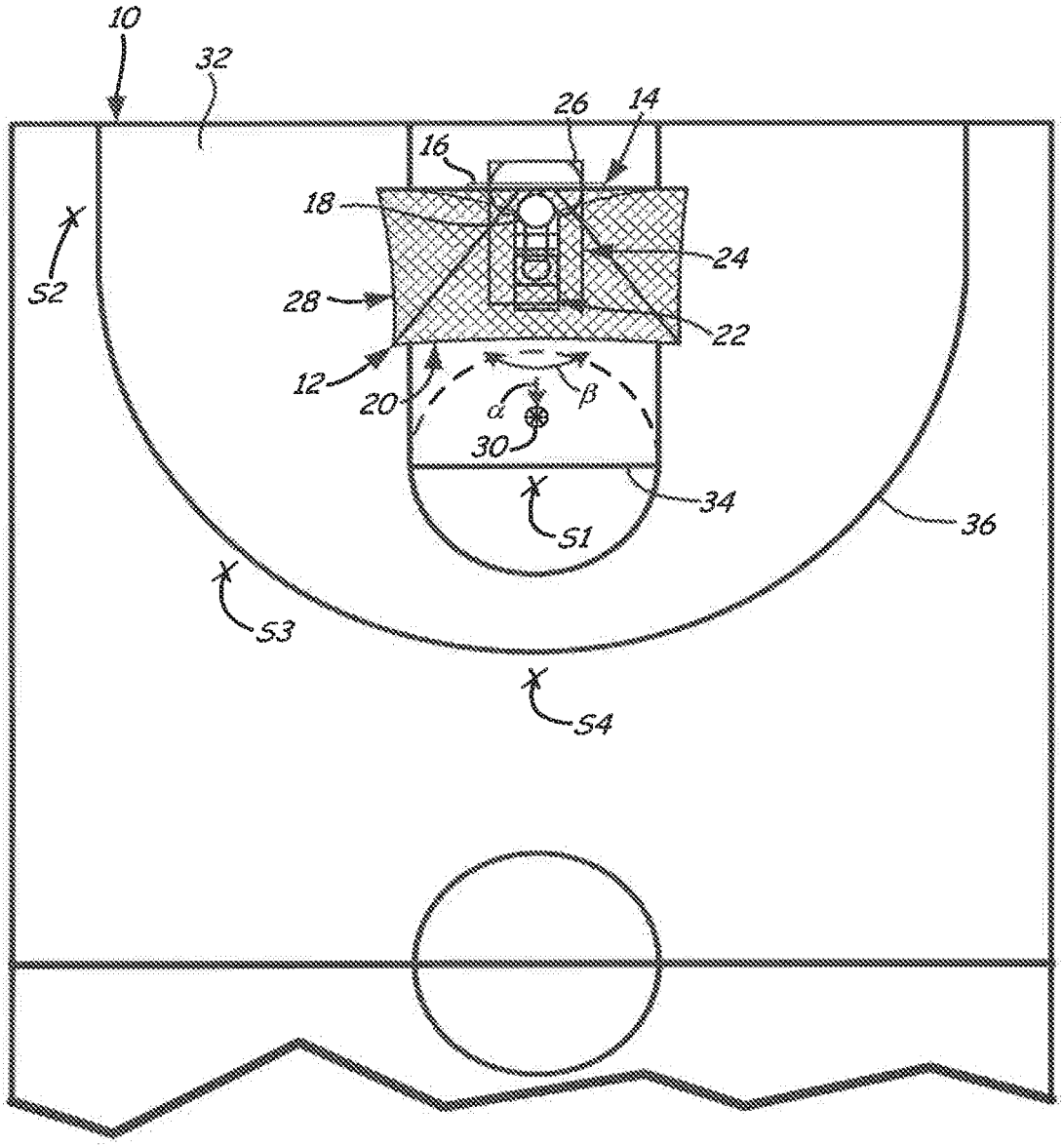
FIG. 1 is an overhead schematic view of a basketball court with a basketball return apparatus positioned for use near a basketball goal.

FIG. 1 is an overhead view of basketball court 10 with basketball return apparatus 12 positioned for use near basketball goal 14, which includes backboard 16 and attached hoop 18. Basketball return apparatus 12 includes ball collector 20 and ball returner 22 each connected to base 24. Ball collector 20 is connected to turntable 26 which is connected to base 24. Turntable 26 allows ball collector 20 to rotate, or swivel, with respect to base 24 and ball returner 22. In FIG. 1, ball collector 20 is in a first rotational position.

Ball collector 20 has a top opening defined by rim 28. Basketball return apparatus 12 is positioned near basketball goal 14 with ball collector 20 positioned under hoop 18. In this position, basketball return apparatus 12 can collect basketballs shot at basketball goal 14 in ball collector 20, which funnels the basketballs to ball returner 22. Rim 28 of ball collector 20 is substantially larger than hoop 18 so as to collect basketballs that miss or bounce off of basketball goal 14.

Ball returner 22 can return the collected basketballs to a shooter or another user, by throwing each basketball, such as basketball 30, in a direction $\alpha$. Ball returner 22 can pivot by 210 degrees or more in a direction $\beta$ so as to be able to aim and return basketball 30 to nearly any relevant portion of playing area 32 of basketball court 10. For example, ball returner 22 can return basketball 30 to a user at spot 51 on free-throw line 34 or at spots S2, S3 or S4 on three-point arc 36. This allows one or more users to practice shooting basketballs at various locations on basketball court 10 without having to rebound the shots. Thus, when positioned near basketball goal 14, basketball return apparatus 12 can collect basketballs shot at basketball goal 14 and throw those basketballs to the users at various locations on playing area 32. Basketball return apparatus 12 can be programmed to run one or more drills that determine when and how often basketball return apparatus 12 throws basketballs to spots 51, S2, S3, S4 and/or other spots on basketball court 10. Basketball return apparatus 12 can be used, not just on basketball court 10, but on virtually any suitable playing surface, such as a user's driveway.

Figure 2:
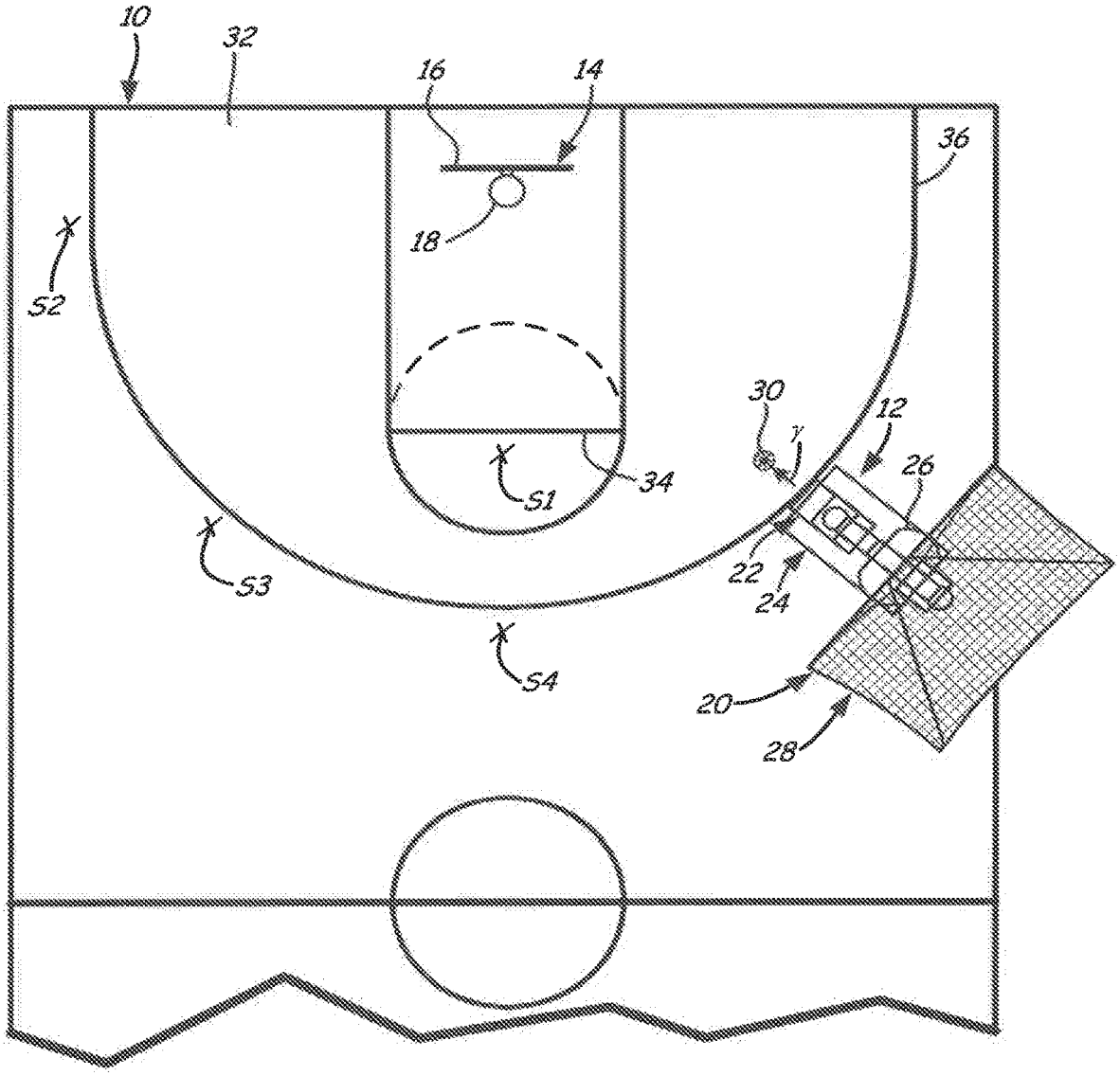
FIG. 2 is an overhead schematic view of the basketball court with the basketball return apparatus of FIG. 1, position for use away from the basketball goal.

FIG. 2 is an overhead view of basketball court 10 with basketball return apparatus 12 position for use away from basketball goal 14. In this case, basketball return apparatus 12 is positioned along three-point arc 36. Ball returner 22 is aimed in a direction $\gamma$ toward playing area 32 of basketball court 10. Turntable 26 has been rotated 180 degrees from the first rotational position (shown in FIG. 1) to a second rotational position, so that ball collector 20 has also been rotated by the same 180 degrees with respect to ball returner 22 and base 24.

Thus, when positioned away from basketball goal 14, basketball return apparatus 12 no longer collects basketballs shot at basketball goal 14. Instead, basketball return apparatus 12 can be positioned virtually anywhere on basketball court 10 and used to throw basketball 30 to users at various locations on playing area 32. From these additional locations, basketball return apparatus 12 can run one or more additional drill programs to simulate various passes, such as an inbound pass, low post pass, high post pass, lob pass, bounce pass, etc. to spots S 1, S2, S3, S4 and/or other spots on basketball court 10. Basketball return apparatus 12 can even thrown basketball 30 toward basketball goal 14 to simulate missed shots for rebounding practice. In order to reload basketball return apparatus 12 with more basketballs, users can throw basketballs over rim 28 into ball collector 20. Basketball return apparatus 12 can be used by various users, such as a shooter, coach, or trainer.

Figure 3:
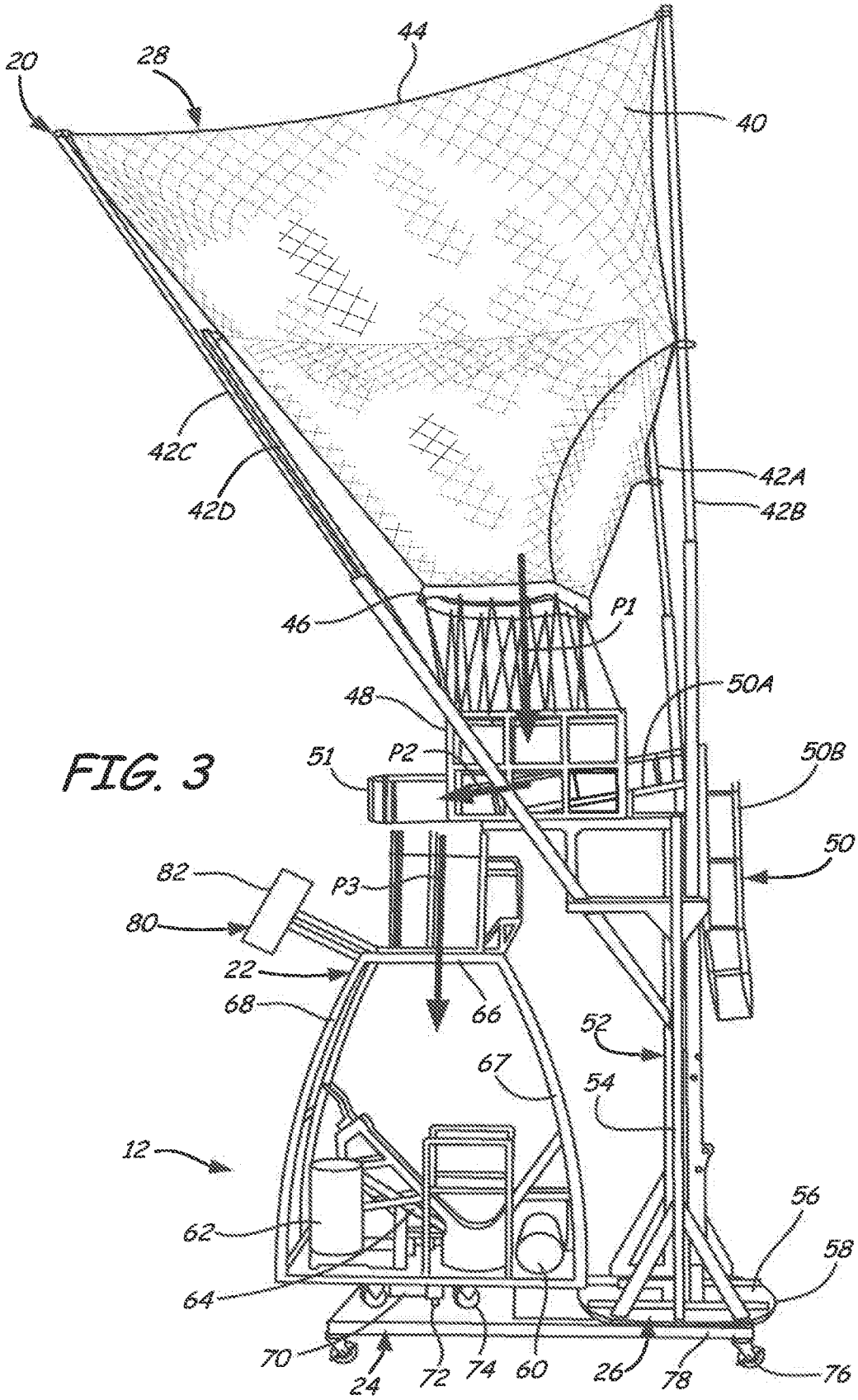
FIG. 3 is a side view of the basketball return apparatus of FIG. 1.

FIG. 3 is a side view of basketball return apparatus 12 with basketball collector 20 in the first rotational position, rotated for use near basketball goal 14 (as shown in FIG. 1). In the illustrated embodiment, basketball collector 20 includes net 40 stretched between four telescoping frame poles 42A-42D. Net 40 has top opening 44, defined by rim 28, and bottom opening 46. Bottom opening 46 is tied to ball path cage 48 so as to create first vertical path P1 for basketballs to pass from ball collector 20 to ball path cage 48. Positioned partially inside ball path cage 48 is ramp 50, which includes main ramp section 50A hingedly connected to extendable ramp section 50B. Main ramp section 50A is also hingedly connected to ball path cage 48. When ramp 50 is in a folded ramp position, main ramp section 50A is inclined so that basketballs entering ball path cage 48 along first vertical path P1 are directed forward along first inclined path P2 to end rail 51 of ball path cage 48, at which point the basketballs can drop down along second vertical path P3 into ball returner 22. First vertical path P1, first inclined path P2, and second vertical path P3 collectively form a first ball pathway between ball collector 20 and ball returner 22. When ramp 50 is in the folded ramp position, extendable ramp section 50B is stored vertically against support mechanism 52.

Support mechanism 52 connects ball collector 20, ball path cage 48, and ramp 50 to base 24. Support mechanism 52 includes support frame 54 and turntable 26. Top platform 56 of turntable 26 is rotatably connected to bottom platform 58 of turntable 26, and support frame 54 is fixedly connected to top platform 56. Bottom platform 58 is fixedly connected to base 24. Features and operation of ramp 50, support mechanism 52, turntable 26, and other components of basketball return apparatus 12 are further described in a provisional application Ser. No. 61/419,686 entitled "BASKETBALL RETURN APPARATUS WITH ROTATABLE BALL COLLECTOR" which was filed on Dec. 3, 2010 and is assigned to the same assignee as this application, the disclosure of which is incorporated by reference in its entirety.

Ball returner 22 receives basketballs from ball path cage 48 through returner inlet 66. In the illustrated embodiment, ball returner 22 is a motorized ball returner having pneumatic pump motor 60, one or more air tanks 62, and throwing arm 64 all connected to ball returner frame 67. Pneumatic pump motor 60 is an ejection motor for actuating throwing arm 64. Pneumatic pump motor 60 delivers compressed air to air tanks 62. Air in air tanks 62 is released with a valve (not shown) to drive throwing arm 64 to throw basketballs out through returner outlet 68. In other embodiments, ball returner 22 can be another type of motorized ball returner or even a non-motorized ball returner such as a ramp. For example, ball returner 22 can be a ramp such as the ball return mechanism 34 disclosed in U.S. Pat. No. 8,147,356 entitled "Basketball Return Apparatus" and assigned to Airborne Athletics, Inc.

Ball returner 22 also has pivot motor 70 fixedly connected to ball returner frame 67. Pivot motor 70 has shaft 72 connected to base 24. Pivot motor 70 drives ball returner 22 to pivot with respect to base 24, as described above with respect to FIG. 1. Pivot motor 70, pneumatic pump motor 60, and the rest of basketball return apparatus 12 can be powered with power supply 73 (shown in FIG. 4), such as an on-board direct current (DC) battery or by an external 120 volt or 240 volt alternating current (AC) power supply. One or more rollers 74 are attached to ball returner frame 67 for rolling against base 24 and for supporting ball returner 22 as it pivots.

Base 24 has caster wheels 76 attached at each corner of a substantially rectangular base platform 78 for rolling basketball return apparatus 12 to desired positions on and off basketball court 10 (shown in FIGS. 1 and 2). In the illustrated embodiment, base 24 includes a single base platform 78 to which both ball collector 20 and ball returner 22 are attached. In an alternative embodiment, base 24 can have multiple detachable base platforms so that ball collector 20 is detachably connected to ball returner 22. In further alternative embodiments, ball returner 22 can operate without an attached ball collector 20.

Ball returner 22 has an integrated computer 80, which has computer housing 82 attached to ball returner frame 67 of ball returner 22. Computer 80 controls operation of ball returner 22, including pneumatic pump motor 60 and pivot motor 70, as further described with respect to FIG. 4.

Figure 4:
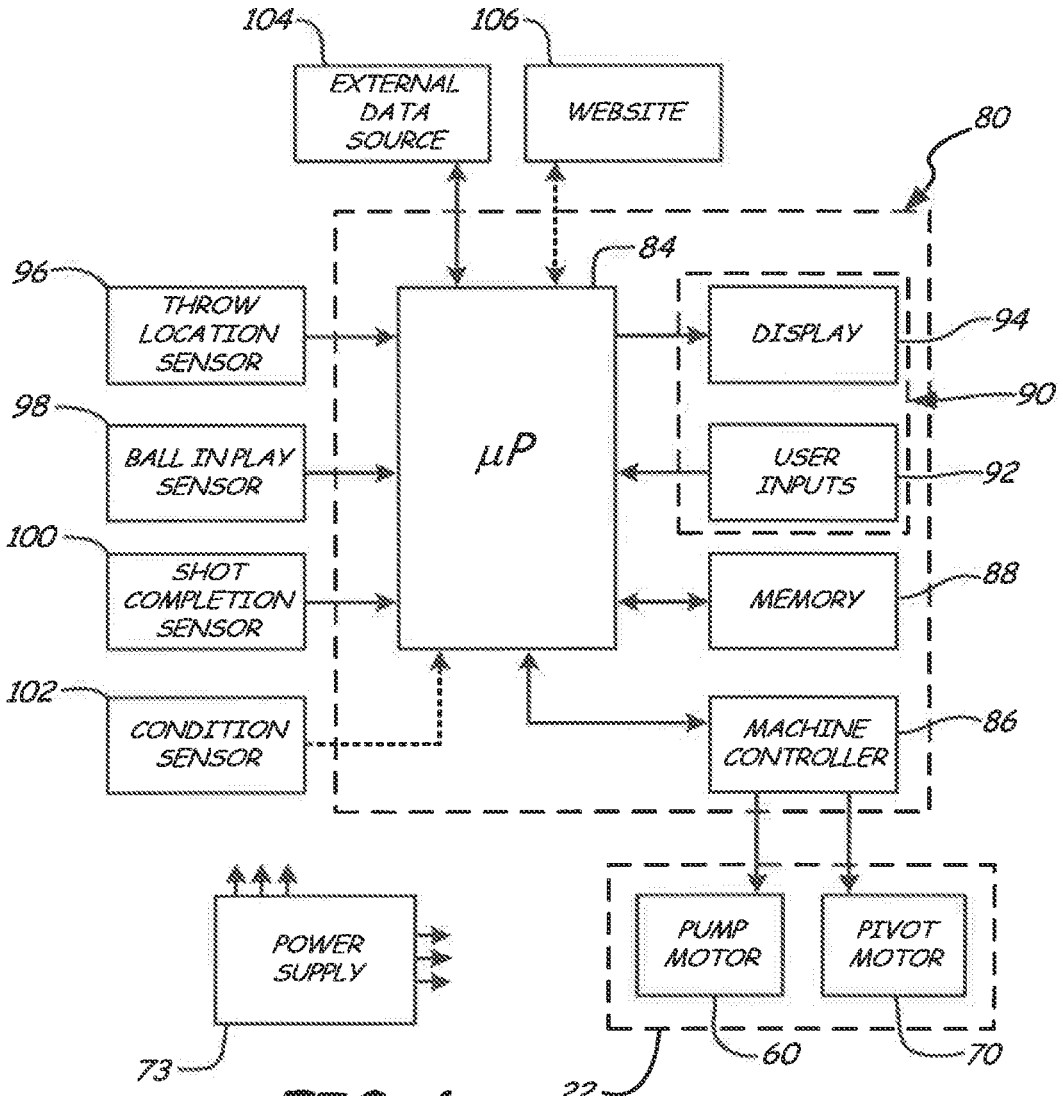
FIG. 4 is a schematic block diagram of a computer that controls operation of the basketball return apparatus of FIG. 1 and the computer's corresponding electrical and data connections.

FIG. 4 is a schematic block diagram of computer 80 and its corresponding electrical and data connections. In one embodiment, computer 80 can be a notebook or netbook style computer. Computer 80 includes microprocessor 84, which is connected to machine controller 86, memory 88, and user interface 90 (which includes user inputs 92 and display 94). User interface 90 can be integral with computer housing 82 (shown in FIG. 3) or can be housed separately. In one embodiment, user interface 90 can be a touch screen, integrating user inputs 92 and display 94 together. User interface 90 allows a user to operate basketball return apparatus 12 (shown in FIGS. 1-3) via user inputs 92 and to monitor operation of basketball return apparatus 12 via display 94. Computer 80 is powered by power supply 73.

Machine controller 86 is connected to pump motor 60 and pivot motor 70 for sending control signals to pump motor 60 and pivot motor 70. Machine controller 86 controls angle and velocity with which ball returner 22 throws balls to a user. Memory 88 stores data used by computer 80 to operate basketball return apparatus 12, including drill program instructions for operating ball returner 22. Microprocessor 84 signals machine controller 86 to operate pump motor 60 and pivot motor 70 in accordance with particular drill program instructions stored in memory 88.

For example, a user can use user interface 90 to select a first drill program for basketball return apparatus 12 to perform. In this example, the first drill program is designed to throw ten balls each to spots 51, S2, and S3 along three-point arc 36 (shown in FIG. 1), allowing the user to shoot ten shots from each spot 51, S2, and S3 before moving to the next. In response to the user selecting the first drill program, microprocessor 84 can query memory 88 for a first set of drill program instructions which correspond to the first drill program. Microprocessor 84 can then signal machine controller 86 to instruct pivot motor 70 to rotate in a direction of spot S2 and instruct pump motor 60 to throw a basketball with a sufficient force to reach spot S2. Pump motor 60 can be instructed to throw the basketball ten times, with a suitable delay in between each throw. After the tenth throw, microprocessor 84 can then signal machine controller 86 to instruct pivot motor 70 to rotate in a direction of spot S3 and instruct pump motor 60 to throw a basketball with a sufficient force to reach spot S3 ten times. This can be repeated for spot S4, at which point the first drill program is complete.

Computer 80 receives information from various sensors. One or more throw location sensors 96 sends a throw location signal to computer 80, which uses the throw location signal to determine where ball returner 22 throws each basketball. In one embodiment, throw location sensor 96 can be a potentiometer for determining which direction ball returner 22 is aiming. If throw location sensor 96 indicates that ball returner 22 is not aiming in a direction appropriate for a particular drill program, computer 80 can receive that indication and direct pivot motor 70 to rotate until throw location sensor 96 indicates that ball returner 22 is aiming in the appropriate direction. In other embodiments, throw location sensor 96 can also provide feedback related to height and distance of each throw.

Ball in play sensor 98 senses each time when ball returner 22 throws a basketball. Ball in play sensor 98 sends a ball in play signal to computer 80, which uses the ball in play signal to determine how long to wait before instructing pump motor 60 to throw another basketball.

Shot completion sensor 100 senses each time a basketball passes through hoop 18. Shot completion sensor 100 sends a shot completion signal to computer 80, which compares the shot completion signal to the ball in play signal to calculate a shot completion percentage. For example, if ball in play sensor 98 senses that ten basketballs are put in play and shot completion sensor 100 senses that only five basketballs passed through hoop 18, then computer 80 can calculate shooting percentage as 50%. In various embodiments, shot completion sensor 100 can be an ultrasonic sensor, an optical sensor, a mechanical switch, or another sensor suitable for determining whether a basketball passes through hoop 18. Computer 80 can display shooting percentage to the user via display 94 to give the user feedback on his or her performance.

By incorporating throw location signal data from throw location sensors 96, microprocessor 84 of computer 80 can calculate shooting percentage as a function of shot location. For example, if a user takes one hundred shots each from spots S2, S3, and S4, computer 80 might determine that the user completed 20% of the shots from spot S2, 40% of the shots from spot S3, and 45% of the shots from spot S4. After viewing this information on display 94, the user can determine which locations could benefit most from additional practice. Shot completion sensor 100 can communicate with computer 80 over a wired or wireless connection. In one embodiment, shot completion sensor 100 can be an ultrasonic ball sensor that hangs from rim 18 or backboard 16.

Condition sensor 102 senses one or more physical conditions of a user, such as heart rate, blood pressure, respiratory rate, fatigue, etc. In one embodiment, condition sensor 102 is a heart rate monitor for sensing a user's heart rate. In another embodiment, condition sensor 102 is an oximeter for sensing oxygen saturation levels in a user's blood. In yet another embodiment, condition sensor 102 is a lactic acid monitor for sensing lactic acid in user's system. In other embodiments, condition sensor 102 can sense one or more other physical conditions of a user in addition to, or instead of, one or more of the conditions listed above.

Condition sensor 102 sends a physical condition signal to computer 80. In one embodiment, condition sensor 102 can be worn on a user's body during the course of a drill program or an extended training session that includes multiple drill programs. For example, condition sensor 102 can be worn on a headband, on a wristband, on a chest-strap, and/or on a belt. When worn by the user, condition sensor 102 can send the physical condition signal to computer 80 wirelessly. In another embodiment, condition sensor 102 can be physically connected to basketball return apparatus 12, such as being integrated with user interface 90. When integrated with user interface 90, condition sensor 102 can be used by the user before, after, and during breaks in a drill program or the user's overall training session.

Computer 80 receives the physical condition signal from condition sensor 102, and stores physical condition data in memory 88. Physical condition data can include heart rate, blood pressure, respiratory rate, fatigue, calories burned by a shooter or user, and/or shooting percentage as a function of physical condition. Microprocessor 84 of computer 80 can calculate shooting percentage as a function of physical condition of a user. Computer 80 can then output physical condition data via an output interface such as user interface 90, external data source 104 or website 106. In one embodiment, computer 80 displays shooting percentage a function of one or more physical conditions to the user via display 94 on user interface 90. This provides feedback of not only how well or poorly the user is shooting, but can also provide helpful feedback regarding why the user is shooting either well or poorly. After viewing this information on display 94, the user can determine whether to modify his or her diet, conditioning, or other factors than can affect his or her physical condition.

In one embodiment, external data source 104 is an external computer (such as a laptop computer, a computer workstation, a personal computer, a personal digital assistant, a cellular phone, a mobile phone, a smart phone, a digital tablet, an internet appliance, or virtually any suitable device), connected to computer 80 via a wired or wireless connection (such as Bluetooth, WiMax, 802.11a, 802.11b, 802.11g, 802.11n, a proprietary communications network, infrared, optical, or the public switched telephone network). In another embodiment, external data source 104 is a USB device or other data storage device for transferring data from computer 80 to an external computer.

Computer 80 can store data from the various sensors 96, 98, 100, and 102 in memory 88. The data can be stored for multiple users over multiple training sessions, over an entire basketball season, and even over each users' entire career. This allows a user to track progress over time. Shooting percentage data, as a function of shot location and as a function of one or more physical conditions, can be of interest not just to the user, but can also be of interest to the user's coach or other trainer.

Shooting percentage data can be viewed directly on display 94. Alternatively, or additionally, shooting percentage data can be transferred to external data source 104. Computer 80 can save the shooting percentage data in virtually any format suitable for use on an external computer, such as comma-separated value ("csv") database file or other suitable file format. This allows a user to review physical condition data, shooting percentage data, and other data from the various sensors 96, 98, 100, and 102 on an external computer away from basketball return apparatus 12, or to share that data with the user's trainer, coach, or someone else for review away from basketball return apparatus 12. Physical condition data, shooting percentage data, and other data from the various sensors 96, 98, 100, and 102 can also be transferred to and available for review on website 106.

A user can conceive various drill programs for use with basketball return apparatus 12 that were not originally programmed into computer 80. The user can create a custom drill program via user interface 90, external data source 104, and/or website 106. In one embodiment, a user can use website 106 to create a custom drill program. The custom drill program can be similar to existing drill programs with only minor modifications or can be a vastly different basketball drill program. Website 106 can then translate the custom drill program into a set of basketball drill program instructions that are executable by basketball return apparatus 12. Then, computer 80 can download the set of basketball drill program instructions from website 106 to be stored in memory 88. Thus, the basketball drill program instructions available on website 106 can be referred to as internet-based basketball drill program instructions.

Each new custom drill program need not be used only by the user that created it. Rather, users can share the custom drill programs they create with other users via website 106. Thus, each use can view a plurality of custom drill programs on website 106 and download sets of internet-based basketball drill program instructions corresponding to the custom drill programs the user desires. Users can create the custom drill programs directly on website 106 for sharing. Alternatively or in addition, users can create the custom drill programs using computer 80 and/or external data source 104, and then upload those custom drill programs to website 106. Custom drill programs can be created by manufacturers of basketball return apparatus 12, by purchasers of basketball return apparatus 12, or by other parties.

Website 106 can provide videos and/or simulations of each custom drill program to illustrate the custom drill program to a potential user. This allows a potential user to determine whether the custom drill program is desirable prior to downloading the corresponding set of internet-based basketball drill program instructions to the user's basketball return apparatus 12.

Computer 80 can also control ball returner 22 as a function of physical condition data from condition sensor 102. For example, computer 80 can execute a heart rate drill that seeks to keep a user's heart rate at or near a target heart rate. The heart rate drill can start by the user entering a desired target heart rate. Then computer 80 can control pump motor 60 and pivot motor 70 of ball returner 22 to function at increasing or decreasing rates depending on whether the user's sensed heart rate is greater than or less than the users target heart rate. For example, if the user entered a target heart rate of 140 beats per minute but the user's actual heart rate is at 120 beats per minute, computer 80 can control pump motor 60 to throw basketballs at a faster rate. Alternatively, or in addition, computer 80 can control pivot motor 70 to pivot more often and/or pivot more quickly. This can give a user more control over a cardiovascular aspect of an exercise workout.

Figure 5:
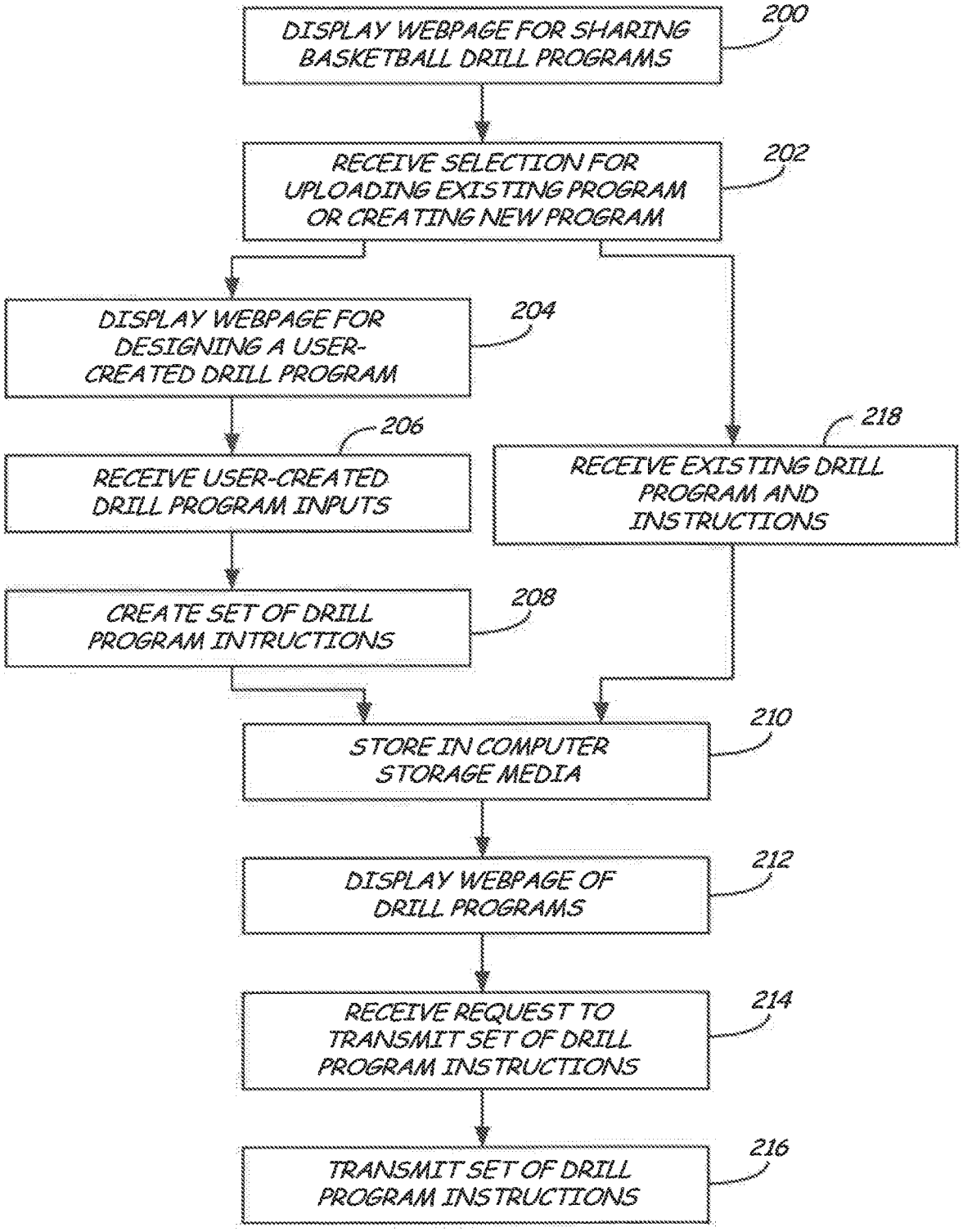
FIG. 5 is a flow chart of a method for programming a motorized basketball return apparatus via a website.

FIG. 5 is a flow chart of a method for programming basketball return apparatus 12 via website 106. To begin, a webpage for sharing basketball drill programs is displayed via website 106 (step 200). Then, a selection is received from a user for either uploading an existing basketball drill program or for designing a new basketball drill program via website 106 (step 202). If the user chooses to design a new basketball drill program, then a webpage for designing a user-created basketball drill programs is displayed (step 204). Then inputs from the user are received to define the user-created basketball drill program (step 206). A set of basketball drill program instructions that are executable by basketball return apparatus 12 (shown in FIGS. 1-3) are created to correspond to the user-created basketball drill program (step 208). Then the user-created basketball drill program and corresponding set of internet-based basketball drill program instructions are stored in one or more computer storage media and is now available for download by the creating user and/or other users (step 210). Upon request, a webpage is displayed containing a plurality of basketball drill programs, including the user-created basketball drill program designed in step 204 (step 212). Then a request is received from a computer to transmit a first sent of basketball drill program instructions (step 214). The first set of basketball drill program instructions can correspond to the user-created basketball drill program designed in step 204, or to another internet-based basketball drill program. Finally, the first set of basketball drill program instructions are transmitted to the computer that made the request (step 216). The requesting and receiving computer can be computer 80 (shown in FIG. 4) or external data source 104 (shown in FIG. 4). Alternatively, external data source 104 could make the request received in step 214 and the first set of basketball drill program instructions can be transmitted to computer 80 in step 216. In any case, the first set of basketball drill program instructions can ultimately be transferred to memory 88 to allow basketball return apparatus 12 to perform the selected internet-based drill program.

If at step 202 the user chooses to upload an existing basketball drill program, then that basketball drill program and a corresponding set of basketball drill program instructions are received from the user (step 218). In that case, steps 204, 206, and 208 can be omitted. The existing basketball drill program can be created using computer 80 or external data source 104 prior to uploading.

One or more of steps 200-218 can be repeated to transmit a second set of basketball drill program instructions that correspond to a second internet-based drill program to the computer that made the request.

In an alternative embodiment, basketball return apparatus 12 (described with respect to FIGS. 1-4) can be used for another court sport: volleyball. In that case, basketball return apparatus 12 can be used with volleyballs, and effectively become a volleyball return apparatus. In one embodiment, ball returner 22 (shown in FIGS. 1-3) could be modified to include some or all of the features of a conventional volleyball return apparatus, such as the AirCAT product available from Airborne Athletics, Inc. of Belle Plaine, Minn. Modifications to the structure and function of basketball return apparatus 12 can be made as necessary so as to be suitable for use with volleyball training. In another embodiment, basketball return apparatus 12 could be completely replaced with a conventional volleyball return apparatus, such as the AirCAT product, that is modified to include computer 80. In either embodiment, the method for programming described with respect to FIG. 5 can be used for volleyball drills instead of basketball drills. Angle, trajectory, and velocity of balls passed for volleyball training drills can be different from that of basketball training drills. However, many of the features and functions described above can be equally valuable for both basketball and volleyball training, including those regarding sensing of physical conditions of a user and those regarding internet-based drill programs. In still other alternative embodiments, basketball return apparatus 12 and the associated features and functions can be modified for other athletic ball related sports, such as soccer (also known as association football).

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. For example, a basketball return apparatus can have additional sensors, motors, electronics, or other features not specifically described herein without departing from the essential scope of the invention.

The invention claimed is:

1. A basketball training system comprising:

a base mounted on four wheels;

a ball collector comprising a frame having telescoping frame poles and a net connected between the telescoping frame poles, wherein the ball collector is mounted to the base;

a mechanical ball returner for returning balls, the mechanical ball returner operably connected to the base, the mechanical ball returner comprising:

a throwing arm and a first motor configured for actuating the throwing arm;

a pivot motor configured for pivoting the mechanical ball returner about a substantially vertical axis relative to the base;

a user interface comprising a touch screen, wherein the user interface is mounted to the mechanical ball returner;

a shot completion sensor positionable with respect to a basketball hoop and configured to sense a ball going through the basketball hoop;

a condition sensor comprising a heart rate monitor and a chest strap, the condition sensor configured to be worn by a basketball shooter for sensing a physical condition of the basketball shooter, the physical condition including heart rate of the basketball shooter; and a computer having a at least one processor and memory, wherein the computer is in data communication with the shot completion sensor and the condition sensor, the computer configured to:

receive data from the shot completion sensor and the condition sensor, wherein the computer receives data from at least the condition sensor over a wireless connection;

store calculated shot completion percentage data and the heart rate of the basketball shooter; and output the calculated shot completion percentage and the heart rate of the basketball shooter to a display so as to display the shot completion percentage as a function of the heart rate of the basketball shooter.

2. The basketball training system of claim 1, wherein the touch screen is configured to receive touches of the touch screen as user input commands to control operation of the computer.

3. The basketball training system of claim 2, wherein the computer is further configured to control operation of the mechanical ball returner responsive to the user input commands.

4. The basketball training system of claim 1, wherein the computer is further configured to output the calculated shot completion percentage as a function of the heart rate of the basketball shooter in a format suitable to be displayed as a website accessible by a remote computer.

5. The basketball training system of claim 1, wherein the computer is further configured to store the calculated shot completion percentage data and the sensed physical condition of the basketball shooter at both the memory of the computer and at an external data source.

6. The basketball training system of claim 1, wherein the computer is further configured to:

receive internet-based drill program instructions;

control the pivot motor of the mechanical ball returner to aim in a plurality of directions based on the internet-based drill program instructions; and controlling the mechanical ball returner to throw basketballs to the basketball shooter based on the internet-based drill program instructions.

7. The basketball training system of claim 1, wherein the touch screen has a display in communication with the computer and is configured to display a plurality of different user-created drill programs, wherein the touch screen is configured to receive a user input selecting one of the different user-created drill programs, and wherein the computer is configured to drive the mechanical ball returner to perform the selected one of the different user-created drill programs.

8. The basketball training system of claim 1, wherein the computer is further configured to:

download from the Internet a plurality of custom drill programs that are each generated by a plurality of different users.

9. The basketball training system of claim 1, and further comprising:

a display in communication with the computer and configured to display the shot completion percentage as a function of the heart rate.

10. A method comprising:

sensing heart rate of a basketball shooter using a physical condition sensor comprising a heart rate monitor and a strap;

generating heart rate data for the basketball shooter with at least one processor based on signals received from the heart rate monitor of the physical condition sensor;

receiving shot completion data from a shot completion sensor;

relating the shot completion data for the basketball shooter with the heart rate data for the basketball shooter for at least one training session of the basketball shooter;

calculating the shot completion data and the heart rate data for the basketball shooter for the at least one training session of the basketball shooter;

displaying calculated shot completion percentage data as a function of the heart rate data for the basketball shooter on a display;

receiving internet-based drill program instructions;

controlling a mechanical ball returner to aim in a plurality of directions based on the internet-based drill program instructions;

controlling the mechanical ball returner to throw basketballs to the basketball shooter based on the internet-based drill program instructions when the mechanical ball returner is aiming in the plurality of directions;

sensing whether a ball shot from the basketball shooter goes through a basketball hoop with the shot completion sensor while the mechanical ball returner executes the internet-based drill program instructions to generate the shot completion data.

11. The method of claim 10, further comprising:

attaching the heart rate monitor and the strap to a chest of the basketball shooter.

12. The method of claim 10, further comprising:

displaying a website for designing user-created basketball drill programs.

13. A method comprising:

sensing heart rate of a basketball shooter using a physical condition sensor comprising a heart rate monitor and a strap;

generating heart rate data for the basketball shooter with at least one processor based on signals received from the heart rate monitor of the physical condition sensor;

receiving shot completion data from a shot completion sensor;

relating the shot completion data for the basketball shooter with the heart rate data for the basketball shooter for at least one training session of the basketball shooter;

calculating the shot completion data and the heart rate data for the basketball shooter for the at least one training session of the basketball shooter;

displaying calculated shot completion percentage data as a function of the heart rate data for the basketball shooter on a display;

receiving a plurality of custom drill programs that are each generated by different users;

sharing the plurality of custom drill programs on the internet;

displaying the plurality of custom drill programs on a website;

receiving a selection for one of the plurality of custom drill programs displayed on the website;

downloading a selected custom drill program; and controlling a mechanical ball returner according to the custom drill program.

14. The method of claim 13, wherein at least some of the custom drill programs are created by manufacturers of the mechanical ball returner, wherein at least some of the custom drill programs are created by purchasers of basketball return apparatus, and wherein at least some of the custom drill programs are created by other parties.

15. A basketball training system comprising:

a shot completion sensor positionable with respect to a basketball hoop, wherein the shot completion sensor is configured and operable to sense a ball going through the basketball hoop;

a condition sensor comprising a heart rate monitor that is configured and operable to sense a heart rate of a basketball shooter;

a computer having at least one processor and memory, wherein the computer is in data communication with the shot completion sensor and the condition sensor, the computer configured to:

receive shot completion data from the shot completion sensor;

receive heart rate data from the condition sensor, wherein the heart rate data is indicative of the heart rate of the basketball shooter;

store the shot completion data received from the shot completion sensor and the heart rate data received from the condition sensor; and output calculated shot completion percentage and the heart rate of the basketball shooter to a display so as to display the shot completion percentage as a function of the heart rate of the basketball shooter; and a display in communication with the computer and configured to display the shot completion percentage as a function of the heart rate of the basketball shooter.

16. The basketball training system of claim 15, wherein the computer is configure to drive the display to display a plurality of user-created drill programs.

17. The basketball training system of claim 15, wherein the computer is configure to drive the display to display shot completion percentage as a function of both heart rate and shot location.

18. The basketball training system of claim 15, wherein the display is a part of a touch screen configured to receive user input commands to control operation of the computer, wherein the computer is further configured to output the calculated shot completion percentage as a function of the heart rate of the basketball shooter via a website accessible by a remote computer.

19. The basketball training system of claim 15, wherein the display is part of a touch screen that is configured to display a plurality of different user-created drill programs, wherein the touch screen is configured to receive a user input selecting one of the different user-created drill programs, and wherein the computer is configured to drive a mechanical ball returner to perform the selected one of the different user-created drill programs.

20. The basketball training system of claim 15, and further comprising:

a ball collector comprising a frame having frame poles and a net connected between the frame poles, wherein the ball collector is mounted to a base;

a mechanical ball returner for returning balls, the mechanical ball returner operably connected to the base, the mechanical ball returner comprising:

a throwing arm and a first motor configured for actuating the throwing arm;

a pivot motor configured for pivoting the mechanical ball returner about a substantially vertical axis relative to the base, wherein the computer is in data communication with the first motor and the pivot motor for controlling operation of the mechanical ball returner.

* * * * *